US007536891B2

(12) United States Patent
Weil et al.

(10) Patent No.: US 7,536,891 B2
(45) Date of Patent: May 26, 2009

(54) ROLL-FORMING OR BENDING MACHINE

(75) Inventors: Wolfgang Weil, Mullheim (DE); Klaus Bassler, Auggen (DE)

(73) Assignee: Weil Engineering GmbH, Müllheim (DE)

( * ) Notice: Subject to any disclaimer, the term of this patent is extended or adjusted under 35 U.S.C. 154(b) by 0 days.

(21) Appl. No.: 11/876,894

(22) Filed: Oct. 23, 2007

(65) Prior Publication Data

US 2008/0098785 A1 May 1, 2008

(30) Foreign Application Priority Data

Oct. 25, 2006 (DE) ..... 10 2006 050 116

(51) Int. Cl.

| | |
|---|---|
| ***B21D 5/14*** | (2006.01) |
| ***B21D 9/00*** | (2006.01) |
| ***B21D 26/00*** | (2006.01) |
| ***B21C 37/06*** | (2006.01) |
| ***B21C 37/30*** | (2006.01) |

(52) U.S. Cl. ..... 72/166; 72/368; 72/369; 72/370.23; 72/466.8

(58) Field of Classification Search ..... 72/51, 72/52, 154, 155, 166, 167, 370.23, 370.24, 72/386, 387, 49, 50, 109, 367.1, 368, 369, 72/465.1, 466, 466.8

See application file for complete search history.

(56) References Cited

U.S. PATENT DOCUMENTS

| | | | | |
|---|---|---|---|---|
| 4,811,587 | A * | 3/1989 | Knudson | 72/181 |
| 5,862,694 | A * | 1/1999 | Horning | 72/52 |
| 5,878,614 | A * | 3/1999 | Okamoto | 72/52 |
| 5,943,892 | A * | 8/1999 | Hoshi et al. | 72/52 |

FOREIGN PATENT DOCUMENTS

| | | |
|---|---|---|
| DE | 1752001 | 4/1971 |

* cited by examiner

*Primary Examiner*—Dana Ross
*Assistant Examiner*—Teresa Bonk
(74) *Attorney, Agent, or Firm*—Volpe and Koenig P.C.

(57) ABSTRACT

A roll-forming or bending machine is provided for forming an angled or rounded and simultaneously tapered hollow body or similar workpiece from a material blank. The machine has at least one tapered roll and at least one counter element, between which a forming pressure can be applied to the material blank. The one counter element has an elastic surface and is constructed as a bending table for supporting the material blanks, so that the one or more rolls apply forming pressure on the material blank on the bending table. The bending table is guided so that it can move in the longitudinal direction and can rotate about a rotational axis, and the rolls can move perpendicular to the longitudinal direction, allowing a change in the relative position of the roll and rotational axis of the bending table caused by a rotational movement of the bending table to be compensated.

15 Claims, 3 Drawing Sheets

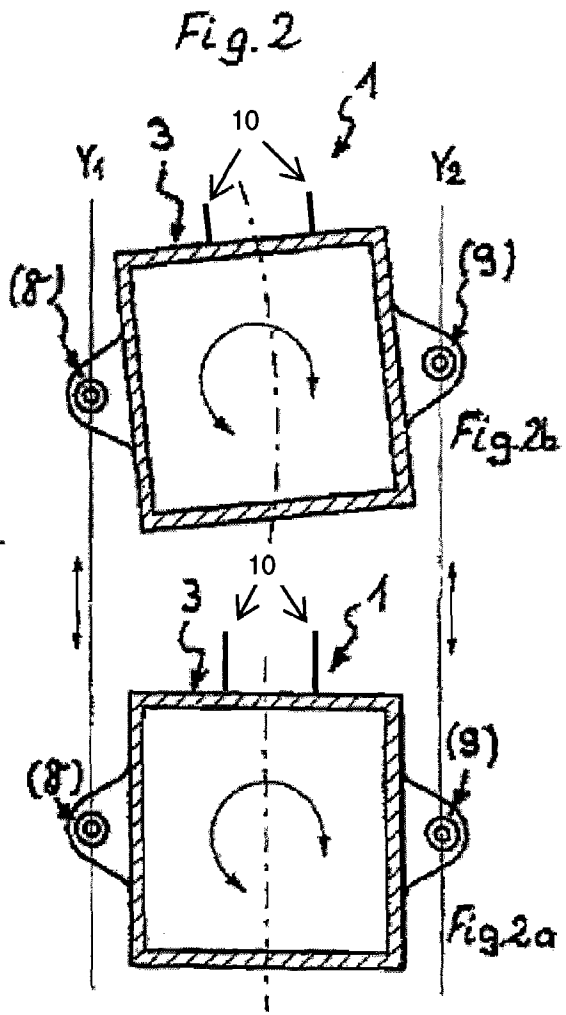
Fig. 2
Fig. 2b
Fig. 2a
1
3
10
9
8
$Y_1$
$Y_2$
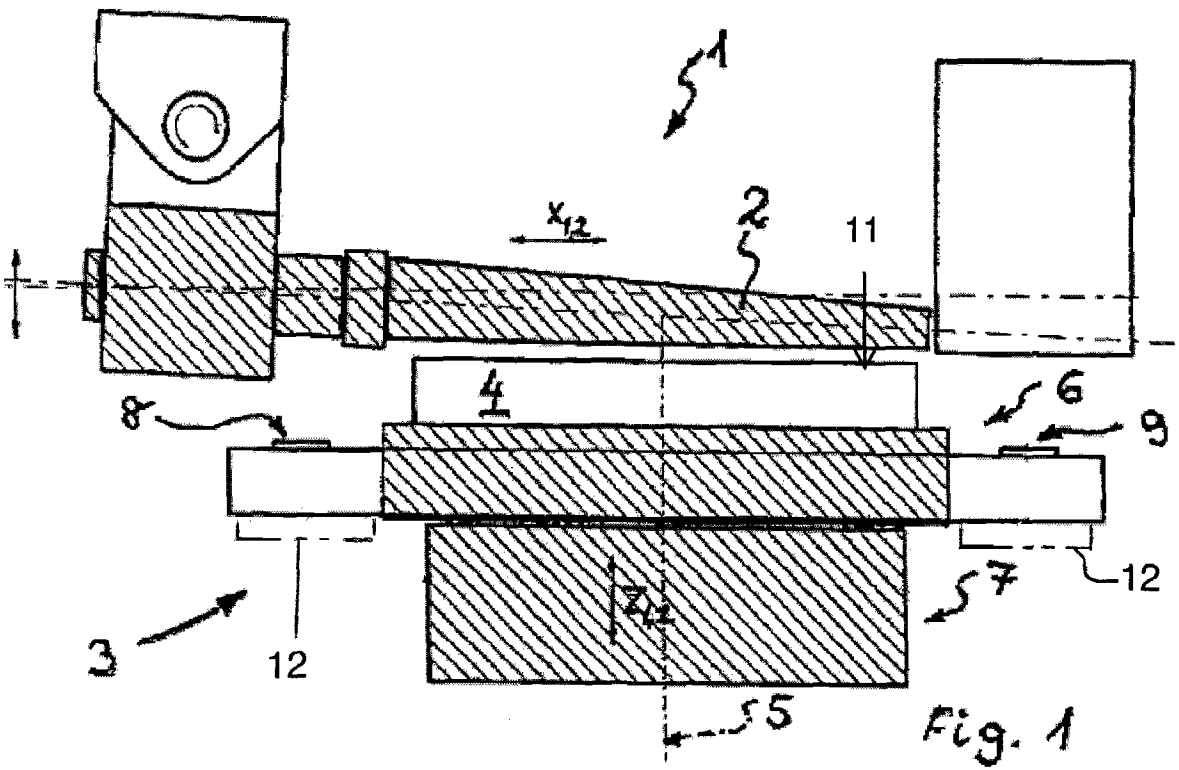
Fig. 1
1
2
3
4
5
6
7
8
9
11
12
$X_{12}$

ROLL-FORMING OR BENDING MACHINE

BACKGROUND

The invention relates to a roll-forming or bending machine, by which an angled or rounded and simultaneously tapered hollow body or similar workpiece can be formed from a material blank, with the roll-forming or bending machine having at least one tapered cylinder and at least one counter element, between which the material blank can be pressed in a forming manner and of which at least the one or more counter elements have an elastic surface.

Exhaust pipes of modern motor vehicles frequently have an exhaust tailpiece, which is not just round or oval, but also expands increasingly conically. In other fields of technology, for example, in furniture construction, comparable hollow bodies are also needed, which have an angled, round, or conical shape and which simultaneously taper, wherein, here, an oval or tri-oval cross section should also be understood as a round or rounded cross section and, for example, a rectangular or polygonal cross section should also be understood as an angled cross section.

Such angled or round and simultaneously tapered workpieces can be produced only with considerable expense. Bending rolls are already known, which have a steel upper roll and a lower roll with an elastic surface made from polyurethane plastic, between which a sheet-metal blank can be made into a round and conical shape simultaneously, with the roll forming of the workpiece being regulated by the contact pressure force and the diameter of the upper roll on the lower roll. In order to equalize the different rotational speeds, which the conical upper roll has in the region of its different roll diameter, the lower roll can be divided into individual roll sections that can rotate independently from each other. Because the lower roll has a corresponding multiple-part and complicated construction and because the rolls of previously known bending machines must feature a correspondingly large roll minimum diameter, in these previously known devices only large workpieces could be produced.

For example, from DE 175 20 01, a roll-forming or bending machine is already known, which is constructed as a sheet-metal rolling machine and in which, a first roll with a solid sleeve, a second driving roll with elastic sleeve acting as a counter element, and their driving devices, as well as a tensioning device for moving the two rolls towards or away from each other, are arranged in a support frame. To be able to use both cylindrical and also conical rolls on the previously known sheet-metal rolling machine and in order to be able to form both cylindrical or rounded as well as tapered workpieces accordingly with the help of the previously known sheet-metal rolling machine, an elongated lever arm, which can pivot about a vertical axis and on which the second roll is held so that it can rotate and on which a force amplifier is built that moves the second roll into the pressure position and into the released position, is attached to the support frame, wherein control devices are provided for changing the pressure exerted by the force amplifier on the rolls. Also for this two-roll sheet-metal rolling machine, the rolls have a comparatively robust and bulky construction, so that only relatively large workpieces can be formed.

SUMMARY

Therefore, there is the objective of creating a roll-forming or bending machine of the type named above, on which workpieces can be shaped or bent, which have, among other things, angled or rounded and simultaneously tapered contours also with small radii, if needed.

This objective is met according to the invention for the roll-forming or bending machine of the type noted above through, in particular, the roll-forming or bending machine having a counter element constructed as a bending table and supporting the material blank, the one or more rolls apply a deforming pressure to the material blank on the bending table, and the bending table being movable in the longitudinal direction and also being guided so that it can rotate about a rotational axis and the one or more rolls can move perpendicular to the longitudinal direction so that a change in the relative position of the roll and rotational axis of the bending table caused by a rotational movement of the bending table can be compensated.

The roll-forming or bending machine according to the invention has a counter element interacting with at least one roll, which is constructed as a bending table and which stamps the material blank. Here, the roll can apply deforming pressure to the material blank on the bending table. During the roll-forming or bending process, the bending table can move in the longitudinal direction and can also be rotated about a rotational axis, while the roll can move, such that the change in relative position of the upper roll and the rotational axis of the bending table caused by rotational movement of the bending table can be compensated. Now, when needed, a small-format workpiece can also be shaped into an angled or round and simultaneously tapered form on the bending table of the roll-forming or bending machine according to the invention. Here, the conicality of the roll can be compensated through rotational movements of the bending table and corresponding feed motions of the roll in the axial direction, without it requiring a roll sub-divided into separately supported roll sections. Because the roll-forming or bending machine according to the invention requires such a sub-divided roll, the one or more rolls of the roll-forming or bending machine can also have a relatively small roll-minimum diameter and can form correspondingly small radii.

So that the bending table is supported so that it can be moved and also rotated and can nevertheless also absorb high deforming and contact forces, it is useful when the bending table has a first table element and a second table element supporting the material blank, with these table elements being able to rotate relative to each other.

In order for the bending table to be able to both move and also rotate in a simple way, a preferred refinement according to the invention, which is worthy of its own protection, provides that a driving means attaches to two opposing sides of the second table element and that the driving means can be driven or moved at different speeds for simultaneous rotation of the table elements relative to each other.

In this way, an especially simple and advantageous embodiment according to the invention provides that coaxial driving belts are used as the driving means and that each driving belt attaches to one of the opposing sides of the second table element.

It is useful when the roll-forming or bending machine according to the invention has a roll with a non-elastic and preferably steel roll surface, while the second table element has an elastic contact surface for the material blank.

It is useful when the contact surface is produced by a plate made from elastic rubber or plastic.

In order to be able to control and change the relative position of the roll, bending table, and material blank mounted in-between, it is advantageous when the material blank can be fixed or set in its position on the bending table. Here, an embodiment according to the invention provides that for fixing or setting the material blank, fixing pins 10 (schematically shown in FIGS. 2*a* and 2*b*) or similar fixing elements are provided, which attach to the outer contours of the material blank with their end region projecting past the bending table and can be lowered in the bending table against a restoring force. In addition to or instead of this, it can be useful when the material blank is arranged in a recess 11 (shown in FIG. 1) of the bending table and when the edge region of the bending table bordering the recess contacts its outer contours at least in some regions for fixing or setting the material blank. Here, the material blank can be fixed on the bending table immovably and securely when the material blank has outer contours that are complementary to the recess.

It is advantageous when the one or more rolls and the bending table can be advanced relative to each other for applying pressure and/or for changing the contact pressure. Here, among other things, the radius of the deformation caused on the material blank can be varied through a different contact pressure between the roll and the bending table.

In order to be able to shape and bend the widest variety of workpieces on the roll-forming or bending machine according to the invention, it is advantageous when the roll is held in the roll-forming or bending machine so that it can be exchanged and when at least two differently shaped rolls are allocated to the roll-forming or bending machine. It is especially useful when at least two rolls of different length and/or at least one cylindrical and also at least one conical roll are allocated to the roll-forming or bending machine. With comparatively short rolls, small bending radii can be formed in the workpiece accordingly. While cylindrical or rounded workpieces can be formed with a straight roll, a conical roll is used for shaping angled or rounded and simultaneously conical workpieces.

The ability to use the roll-forming or bending machine for multiple purposes is increased even more when at least two bending tables and especially at least two second table elements of different widths are allocated to the roll-forming or bending machine (FIG. 4). These tables or table elements can be mounted selectively in the roll-forming or bending machine.

BRIEF DESCRIPTION OF THE DRAWINGS

Additional features according to the invention are disclosed in the claims and also in the drawing. Below, the invention will be explained in more detail with reference to a preferred embodiment.

Shown in schematic representation are:

FIG. 1 a roll-forming or bending machine shown in cross section in the region of its bending table interacting with a roll, wherein the bending table can move and can simultaneously rotate, and FIG. 2 the bending table of the roll-forming or bending machine shown in FIG. 1, wherein driving means attach to both sides of the bending table and wherein the driving means are constructed for moving and simultaneously rotating the bending table at different speeds.

DETAILED DESCRIPTION OF THE PREFERRED EMBODIMENTS

Figure 3:
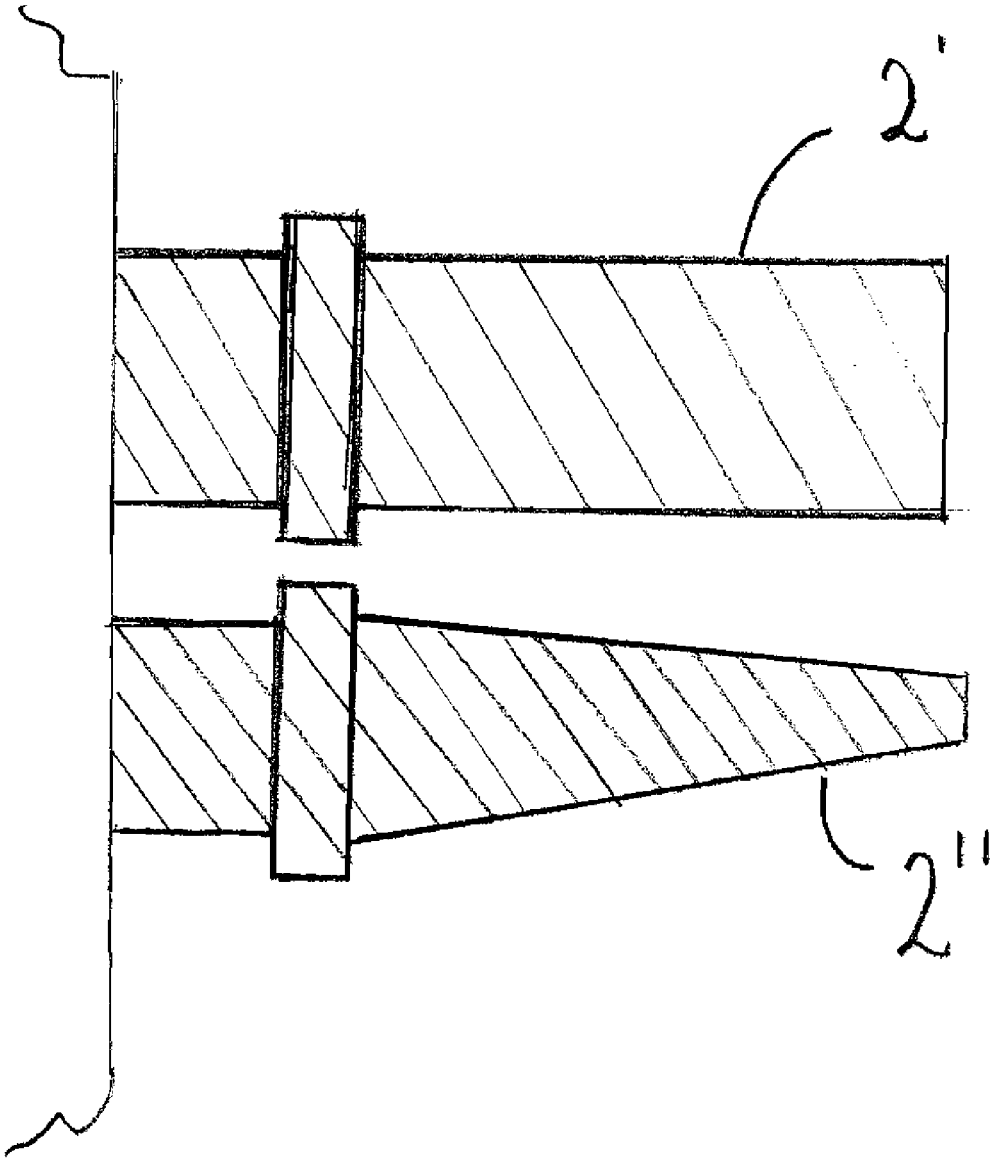
FIG. 3 depicts differently configured rolls that can be interchanged in the machine.
Figure 4:
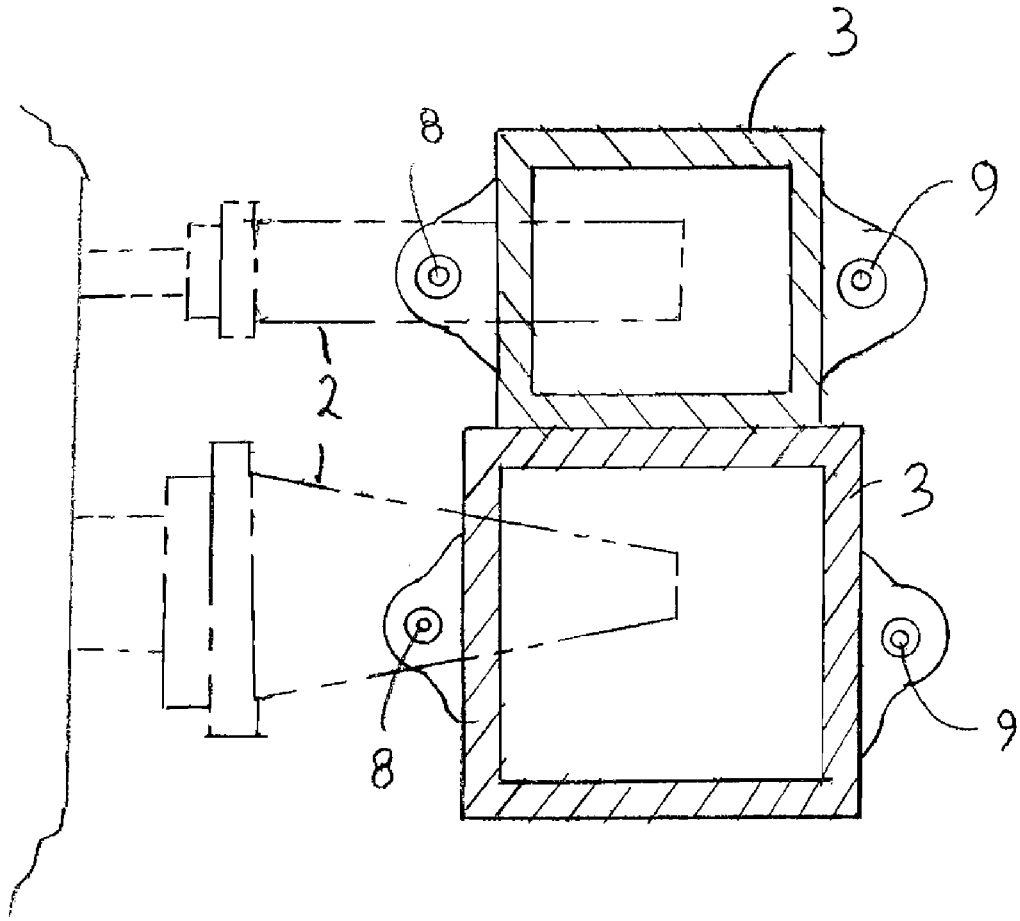
FIG. 4 depicts a top view of a roll-forming or bending machine with two bending tables and two rolls.

In FIGS. 1 and 2 (2*a*, 2*b*), a roll-forming or bending machine 1 is shown, which is used for shaping or bending, among other things, an angled or rounded and simultaneously tapered workpiece from a material blank and especially from a metal sheet.

From FIG. 1 it becomes clear that the roll-forming or bending machine 1 has a tapered roll 2 with a non-elastic and preferably steel surface. The roll 2 interacts with a counter element, which is constructed as a bending table 3 supporting the material blank. The bending table 3 can be advanced in the direction of the double arrow Z1, 2 towards the roll 2, such that a deforming pressure is applied to the material blank—not shown here—between the bending table 3 and roll 2.

For this purpose, the bending table 3 has an elastic surface, which is constructed as an elastic contact surface 4 for the material blank. This contact surface 4 is formed by a plate made from elastic rubber or plastic and, in particular, from PUR plastic.

From a comparison of the FIGS. 1 and 2, it becomes clear that the bending table 3 can move in the longitudinal direction along the lines characterized in FIG. 2 with Y1 and Y2 in the direction of the double arrows and can be rotated simultaneously about the rotational axis 5 (FIG. 1). Here, the bending table 3 is shown in different rotational positions in FIGS. 2*a* and 2*b*. As becomes clear from FIG. 1, the roll 2 can move in the axial direction perpendicular to this longitudinal direction, in the direction of the double arrow indicated in FIG. 1 with X1, 2, such that the change in relative position of the roll 2 and rotational axis 5 of the bending table caused by a rotational movement of the bending table 3 can be compensated.

On the bending table 3 of the roll-forming or bending machine 1 shown here, now, if necessary, a small-format workpiece can also be formed into an angled or round and simultaneously conical shape. Here, the conicality of the roll 2 can be compensated through rotational movements of the bending table 3 and corresponding feed movements of the roll 2 in the axial direction, without requiring a roll sub-divided into separately supported roll sections. Because the roll-forming or bending machine shown here does not require a roll sub-divided in this way, the one or more rolls 2 of the roll-forming or bending machine shown here can also have a comparatively small roll minimum diameter and can form small radii accordingly.

For rotating the material blank on the bending table 3, the bending table 3 has a first table element 6 and a second table element 7, which can rotate relative to each other about the rotational axis 5. For moving the bending table 3, driving means 8, 9 attach to both sides on the second table element. Now, in order to be able to move and simultaneously rotate the material blank on the bending table 3, the driving means 8, 9 attaching to the second table element 7 and constructed preferably as coaxial driving belts 12 can be driven or moved at different speeds.

In order to be able to control and change the relative position of the roll, bending table, and material blank mounted in-between, the material blank can be fixed or set in its position on the bending table 3. For the roll-forming or bending machine 1 shown here, the material blank is arranged in a recess of the bending table 3 and preferably its contact surface 4, wherein the edge region of the bending table 3 bordering the recess contacts its outer contours at least in some regions for fixing or setting the material blank. It is especially advantageous when the material blank has outer contours that are complementary to the recess.

To be able to shape and bend the widest array of workpieces on the roll-forming or bending machine 1 shown here, it is advantageous when the roll 2 is held in the roll-forming or bending machine 1 so that it can be exchanged and when at least two differently shaped rolls 2', 2" (FIG. 3) are allocated to the roll-forming or bending machine. Preferably, at least two rolls of different lengths and/or at least one cylindrical and also at least one conical roll 2 are allocated to the roll-forming and bending machine 1. With relatively short rolls 2, small bending radii can be formed in the workpiece accordingly. While cylindrical or rounded workpieces can be formed with a straight roll 2, a conical roll 2 is used for forming angled or rounded and simultaneously conical workpieces.

In FIG. 1 it is indicated that the roll 2 supported in the form of a floating shaft can be pivoted in the feeding plane with its free roll end in the direction towards the bending table 3.

Workpieces, which, among other things, have angled or rounded and simultaneously tapered contours also with small radii, if necessary, can be produced on the roll-forming or bending machine shown here.

The invention claim is:

1. Roll-forming or bending machine (1) for forming at least one angled or rounded and simultaneously tapered hollow body or workpiece from a material blank, the roll-forming or bending machine (1) comprising at least one tapered roll (2) and at least one counter element, between which a forming pressure is applied to the material blank and of which at least the at least one counter element has an elastic surface, the at least one counter element comprises a bending table (3) for supporting the material blank, the at least one roll (2) is adapted to apply a deforming pressure to the material blank arranged on the bending table (3), the bending table (3) is guidably supported for movement in a longitudinal direction and can also rotate about a generally vertical rotational axis (5) and the at least one roll (2) can move perpendicular to the longitudinal direction, such that a change in a relative position of the at least one roll (2) and the rotational axis (5) of the bending table (3) caused by a rotational movement of the bending table (3) can be compensated.

2. A roll forming or bending machine according to claim 1, wherein the bending table (3) has first and second table elements (6, 7), which support the material blank and which can rotate relative to each other.

3. A roll forming or bending machine according to claim 2, wherein driving elements (8, 9) are attached to two opposing sides of the second table element (7) and the driving elements (8, 9) can drive or move relative to each other at different speeds for simultaneously rotating the table elements (6, 7).

4. A roll forming or bending machine according to claim 3, wherein coaxial driving belts are provided as the driving elements (8, 9) and the driving belts are each attached to a respective one of the opposite sides of the second table element (7).

5. A roll forming or bending machine according to claim 2, wherein the second table element (7) has an elastic contact surface (4) for the material blank.

6. A roll forming or bending machine according to claim 1, wherein a contact surface (4) of the bending table (3) is produced by a plate made from elastic rubber or plastic.

7. A roll forming or bending machine according to claim 1, wherein the material blank can be fixed or set in its position on the bending table (3).

8. A roll forming or bending machine according to claim 1, wherein the material blank, having outer contours, is arranged in a recess of the bending table and edge regions of the bending table bordering the recess contacts the outer contours of the blank at least in some regions for fixing or setting the material blank.

9. A roll forming or bending machine according to claim 8, wherein the material blank has outer contours that are complementary to the recess.

10. A roll forming or bending machine according to claim 1, wherein the at least one roll (2) and the bending table (3) can be fed relative to each other for applying a pressure and/or for changing a contact pressure.

11. A roll forming or bending machine according to claim 10, wherein the at least one roll (2) is held in the roll-forming or bending machine (1) so that it can be exchanged and at least two differently shaped rolls (2) are allocated to the roll-forming or bending machine (1).

12. A roll forming or bending machine according to claim 11, wherein at least two of the rolls (2) of different lengths and/or at least one cylindrical and also at least one conical roll are allocated to the roll-forming or bending machine (1).

13. Roll-forming or bending machine (1) for forming at least one angled or rounded and simultaneously tapered hollow body or workpiece from a material blank, the roll-forming or bending machine (1) comprising at least one tapered roll (2) and at least one counter element, between which a forming pressure is applied to the material blank and of which at least the at least one counter element has an elastic surface, the at least one counter element comprises a bending table (3) for supporting the material blank, the at least one roll (2) is adapted to apply a deforming pressure to the material blank arranged on the bending table (3), the bending table (3) comprising first and second table elements (6, 7), which support the material blank and which can rotate relative to each other, and also comprises coaxial driving belts (8, 9) that are attached to respective opposite sides of the second table element (7), the coaxial driving belts (8, 9) can drive or move relative to each other at different speeds for simultaneously rotating the table elements (6, 7), the bending table is guidably supported for movement in a longitudinal direction and can also rotate about a rotational axis (5) and the at least one roll (2) can move perpendicular to the longitudinal direction, such that a change in a relative position of the at least one roll (2) and the rotational axis (5) of the bending table (3) caused by a rotational movement of the bending table (3) can be compensated.

14. Roll-forming or bending machine (1) for forming at least one angled or rounded and simultaneously tapered hollow body or workpiece from a material blank, the roll-forming or bending machine (1) comprising at least one tapered roll (2) and at least one counter element, between which a forming pressure is applied to the material blank and of which at least the at least one counter element has an elastic surface, the at least one counter element comprises a bending table (3) for supporting the material blank, the at least one roll (2) is adapted to apply a deforming pressure to the material blank arranged on the bending table (3), the bending table (3) is guidably supported for movement in a longitudinal direction and can also rotate about a rotational axis (5) and the at least one roll (2) can move perpendicular to the longitudinal direction, such that a change in a relative position of the at least one roll (2) and the rotational axis (5) of the bending table (3) caused by a rotational movement of the bending table (3) can be compensated, and wherein fixing pins or similar fixing elements, which attach with end regions thereof projecting past the bending table (3) to outer contours of the material blank and which can be lowered in the bending table (3) against a restoring force, are provided for fixing or setting the material blank.

15. Roll-forming or bending machine (1) for forming at least one angled or rounded and simultaneously tapered hollow body or workpiece from a material blank, the roll-forming or bending machine (1) comprising at least one tapered roll (2) and at least one counter element, between which a forming pressure is applied to the material blank and of which at least the at least one counter element has an elastic surface, the at least one counter element comprises at least two bending tables (3), and at least two second table elements (7) of different widths selectively mountable in the roll-forming or bending machine (1), for supporting the material blank, the at least one roll (2) is adapted to apply a deforming pressure to the material blank arranged on the bending table (3), the bending table (3) is guidably supported for movement in a longitudinal direction and can also rotate about a rotational axis (5) and the at least one roll (2) can move perpendicular to the longitudinal direction, such that a change in a relative position of the at least one roll (2) and the rotational axis (5) of the bending table (3) caused by a rotational movement of the bending table (3) can be compensated.

* * * * *